United States Patent [19]

Keprda

[11] 3,974,346

[45] Aug. 10, 1976

[54] PLURAL SWITCH ASSEMBLY HAVING INDEPENDENT OPERATORS LOCKED IN POSITION BY COVER INTERLOCK

[75] Inventor: Jaroslav Keprda, Munich, Germany

[73] Assignee: Siemens Aktiengesellschaft, Berlin & Munich, Germany

[22] Filed: Jan. 13, 1975

[21] Appl. No.: 540,558

[30] Foreign Application Priority Data

Jan. 17, 1974 Germany ..... 2402173

[52] U.S. Cl. ..... 200/5 B; 200/16 D; 200/50 C; 200/333

[51] Int. Cl.[2] ..... H01H 3/20; H01H 9/26; H01H 13/04

[58] Field of Search ..... 200/5 B, 5 E, 16 C, 200/16 D, 50 C, 333, 334, 329–332, 335–340

[56] References Cited

UNITED STATES PATENTS

| | | | |
|---|---|---|---|
| 3,196,227 | 7/1965 | Carter et al. | 200/50 C |
| 3,492,448 | 1/1970 | Phillips, Jr. | 200/50 C |
| 3,643,042 | 2/1972 | Gratz | 200/16 D |
| 3,674,948 | 7/1972 | Betlejewski et al. | 200/50 C |
| 3,735,059 | 5/1973 | Glaser et al. | 200/16 C |
| 3,778,564 | 12/1973 | Nocella | 200/50 C |
| 3,801,758 | 4/1974 | Shand et al. | 200/333 UX |
| 3,836,736 | 9/1974 | Golbeck | 200/50 C X |
| 3,883,705 | 5/1975 | Sebastian et al. | 200/333 X |
| 3,912,887 | 10/1975 | Gratz et al. | 200/16 D |

*Primary Examiner*—James R. Scott

*Attorney, Agent, or Firm*—Hill, Gross, Simpson, Van Santen, Steadman, Chiara & Simpson

[57] ABSTRACT

A plurality of miniature slide switches are arranged in parallel in a tub shaped common housing, the switches each have a raised actuator projecting toward the top of the housing which is contactable by a raised wedged surface portion on the underside of a closable housing lid to assure that the switches are fully thrown and will be locked in the desired operating state upon closure of the lid.

5 Claims, 4 Drawing Figures

PLURAL SWITCH ASSEMBLY HAVING INDEPENDENT OPERATORS LOCKED IN POSITION BY COVER INTERLOCK

BACKGROUND OF THE INVENTION

1. Field of the Invention

This invention relates to switches and more particularly to a miniature switch assembly of the type referred to as "dual-in-line" in which a multitude of individual switches which can be operated independently from one another are arranged in a common housing with a parallel switching movement.

2. Prior Art

In the construction of electrical systems, present design technique attempts to unify the outer dimensions and connecting measurements of all of the components provided for the installation. To this end, switching arrangements which are designed for use in apparatus utilizing switching techniques have been arranged in square or rectangular plastic housings having a plurality of connecting elements arranged parallel to the longitudinal sidewalls of the housings. Such components are often referred to as "dual-in-line" components. A number of switches can be provided in such a housing with each of the switches being independent of the other switches in the housing and with each switch providing for the electrical connection of a connecting element disposed parallel to one side of the housing with a connecting element disposed parallel to the other side of the housing. However, because of the emphasis of uniform dimensions, such housings are of extremely small size and the switches are quite minute. Because of this small size, it has been extremely difficult to provide the individual switches within a given switch housing with a locking mechanism that guarantees that the individual switches will be fully thrown and safely locked in one of the two switching positions available to each switch.

SUMMARY OF THE INVENTION

My invention, therefore, is directed to the provision of a miniature switch of the above-described type which is designed and constructed in such a way that by means of a relatively simple built-in lock mechanism, will be assured that the individual switches within a given housing are always safely fully thrown to one of the two switching positions and locked in that position.

My invention, therefore, provides a switching arrangement which is designed in such a way that a locking rib, effective to correctly position and lock all of the switches, is movably connected to the housing and positionable crosswise to the direction of movement of the individual switches.

By means of this arrangement of the locking member, it is assured that the locking mechanism for each of the switches within a given housing is centralized in an advantageous manner. Among other things, this means, that in the design of the individual switches, the main design criteria can be directed to the optimization of the contact safety of the individual systems, since the locking device is effective when the switches are in either of their fully thrown switching positions, the locking being accomplished by a device which in no way influences the contact springs of the individual switches.

In a preferred embodiment of the invention, the individual switches are provided within a rectangular shaped housing such that the switches are arranged in parallel between the longitudinal sidewalls of the housing, the switches being actuated by sliding them crosswise of the housing. The locking member can then be provided on the underside of a member which is pivotably attached adjacent a narrow side of the housing. By providing the slide bar of the switches with a raised actuator which projects upwardly towards the open top of the housing, it is assured that the actuator will be contacted by the locking member upon pivoting of the pivotable member to lock the switch in a given position by restricting further movement of the actuator.

In this manner, an especially simple handling of the locking member is achieved.

In addition, the locking member can comprise a raised wedge shaped rib on the undersurface of the pivotable member extending the length of the housing, the rib has slanted sidewalls which can function as a cam surface when contacting the actuator. To this end, the raised actuator is preferably provided with chamfered sidewalls having an angle adjusted to the profile of the wedge shaped surface. By this construction, during shifting of the pivotable member into locked position, the sidewalls of the actuator will contact the cam surface of the locking rib which can then have the effect of moving the actuator further to one side or the other of the housing to force the switch into a fully thrown position. In this manner, it is insured that an "unclear" position of the switches, as might be caused by negligent operation, cannot occur. By matching the surface features of the wedge shaped rib and the actuator, it is further insured that damage to the rib or to the actuator caused by operating locking device will be largely prevented.

In a further modification of the invention, the rib forms a one-piece component of a lid of the housing. Thus, a double function is carried on by the housing lid which, on the one hand, protects the switches from impurities and from unintended operation, while, on the other hand, fixing the switches in the desired fully thrown position.

Further, the lid may be made of transparent material, either entirely or for half of its width as determined by the position of the rib. By this means, it becomes possible to identify the switch positions of the individual switches even when the housing lid is closed. This is because, due to the transparent nature of at least half of the lid, the positions of the actuators of the individual switches can be viewed to determine whether the switches are in the activated or deactivated position.

In a preferred embodiment of the invention, the individual switches are provided with a plate shaped centerpiece, which is supported between an intermediate plate positioned parallel to the housing bottom floor in spaced relationship thereto, and internal divider walls which extend upwardly into the housing and extend crosswise to the longitudinal extension of the housing. The individual switches are then formed with the actuator on one side of the plate shaped centerpiece and the contact spring on the other side of the plate shaped centerpiece located between the divider walls. Thus, the switches are positioned in the housing in such a way that the individual contact springs associated therewith have a contact pressure isolated from influence by operation of the switch. As a consequence of this, the individual springs can, for instance, be constructed of one piece and be freely connected with the switches.

Such an arrangement has an especially advantageous effect.

In the preferred embodiment illustrated, the individual switch bodies are provided with a surface indentation on their bottom faces opposite the floor of the housing. The surface indentation may consist of a V-shaped recess running crosswise to the direction of shifting movement of the switch. The contact spring, which is positioned in a sliding manner on the housing floor, has a portion thereof supported in the V-shaped recess.

The contact spring which forms the electrical contact of the switch mechanism is connected by the V-shaped recess to the switch body and is moved necessarily with the switch body without thereby requiring further attachment means.

A specific shape for the contact spring may include a length of a spring metal sheet band which has spaced projections on the underside of a contact bridge section which runs crosswise to the longitudinal extension of the housing and on the housing floor. The band continues through a reverse bend from one end of the contact bridge section back to approximately the center of the contact bridge section and then extends upwardly into the V-shaped recess with a contact spring stem, which runs vertical to the housing floor. A contact spring constructed according to this teaching is especially suited to guarantee that a safe contact will be established when in the switch-on position, while at the same time providing a largely symmetrical distribution of the contact pressure onto the projections, while maintaining the function of a sliding contact switch.

Finally, according to the switching arrangement of this invention, a plurality of sheet metal strips which are aligned with the surface of the floor are asserted into the housing bottom extending crosswise to the longitudinal extension of the housing with portions of the sheet metal strips protruding from the longitudinal walls of the housing and arranged outside of the housing in the manner of the prior art "dual-in-line" components. The sheet metal strips are bent exterior of the housing to form connecting elements with the bent portions projecting parallel to the walls of the housing.

By this design, the switching arrangement provides a component which is dimensionally consistent with standard "dual-in-line" components but in which a locking mechanism is provided for the switches.

It is, therefore, an object of this invention to provide a plurality of individually operable switches arranged in a common housing with the switches operating in a parallel movement direction with a common locking member for maintaining the switches in a fully thrown position.

It is another and more particular object of this invention to provide a plurality of individually operable slide switches arranged in a common housing, switches having actuator knubs projecting upwardly into an opened-end portion of the housing, the switches being activated in parallel movement by moving the actuator towards one side or the other of the housing, and a common locking member associated with a lid for the housing and effective to maintain the switches in a fully thrown position.

It is yet another more specific object of this invention to provide a plurality of individually actuatable slide switches arranged in a common housing, the switches being positioned for parallel movement between activated and deactivated positions, the switches having actuators projecting upwardly towards an open-end of the housing, the housing being equipped with a pivotable closure lid, the closure lid having a surface interruption on a bottom surface thereof, the surface interruption providing a locking member locking the individual switches in fully thrown position in either the activated or deactivated position upon closure of the lid.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DESCRIPTION OF A PREFERRED EMBODIMENT

Figure 1:
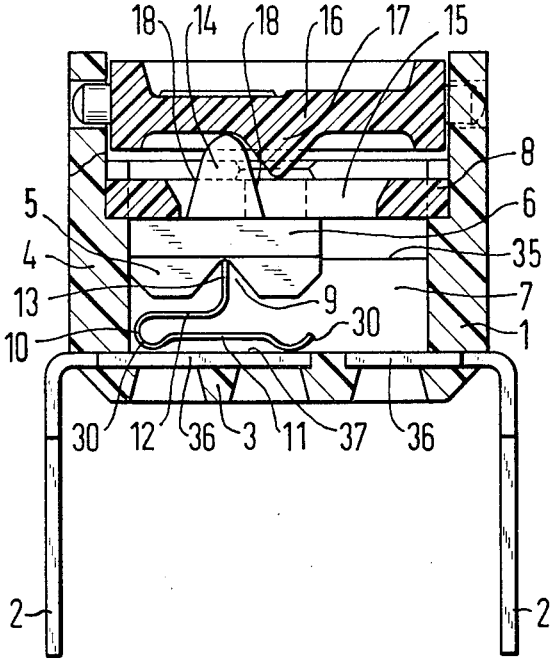
FIG. 1 is an enlarged cross-sectional view of the switches and housing of this invention.

As shown in the figures, a tub shaped housing 1, preferably formed of plastic, is basicaly tub shaped having a height which corresponds substantially to the so-called "dual-in-line" prior art housings. A plurality of individually actuatable slide switches 5 are arranged in the housing crosswise to the longitudinal extension of the housing and next to one another. Each of the slide switches 5, in a first switching position, are effective to electrically connect two connecting elements 2 with each other whereas in a second switching position, the connection is interrupted. The connecting elements 2 consist of sheet metal strips 36 running crosswise to the longitudinal extension of the housing. Contact surfaces 37 of the strips 36 are positioned in the interior of the housing 1 adjacent the bottom floor thereof. The connecting elements 2 project from the longitudinal sidewalls 4 of the housing 1 to the exterior thereof and are bent from the illustrated horizontal position interiorly of the housing to the illustrated vertical position exterior of the housing where they project away from the housing 1 parallel to the longitudinal walls 4.

Interior of the housing 1, a plurality of the slide switches 5 are provided. In the illustrated embodiment, five such switches are provided in a common housing. Switches 5 can be moved back and forth between the longitudinal sidewalls 4. Each of the switches 5 is provided with an increased dimension plate-shaped centerpiece 6 intermediate top and bottom portions of the switch body. The plate-shaped centerpieces 6 rest on the top 35 of internal divider walls 7 which are formed as a part of the housing and which sub-divide the housing crosswise to its longitudinal extension projecting upwardly from the bottom portions of the housing such that the tops thereof 35 form support ledges for the switches. An intermediate plate 8 is inserted into the tub-shaped housing 1 parallel to the housing floor 3 and contacts the top surfaces of the plate-shaped centerpieces of the switches. Thus, the plate-shaped centerpiece of each switch is trapped between the intermediate plate 8 and the surface 35 of divider walls 7 effectively locking the switches in place within the housing while still allowing their parallel movement between the longitudinal sidewalls 4 of the housing.

Figure 2:
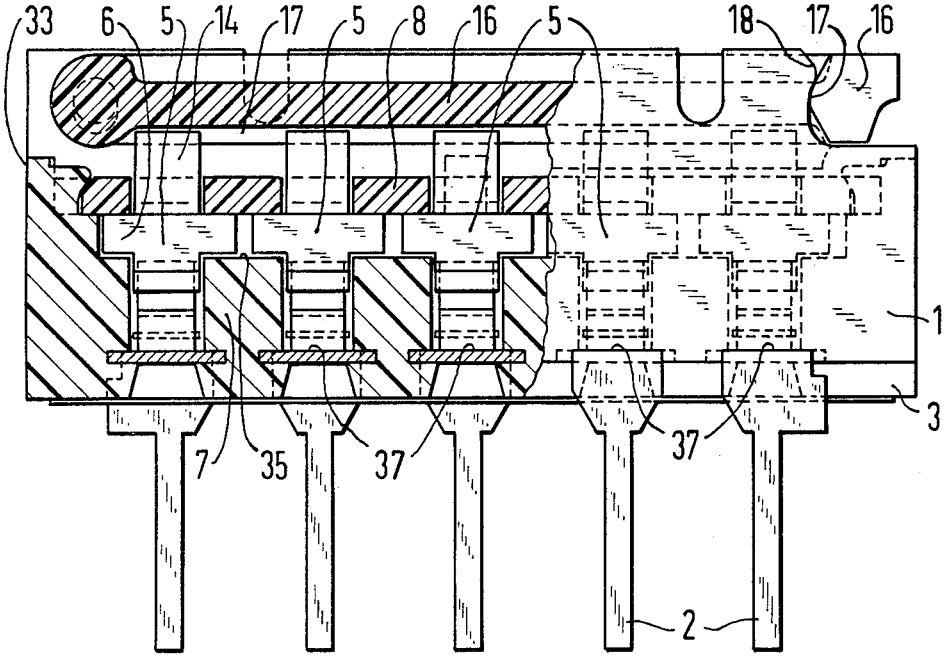
FIG. 2 is a side-view of the switches and housing of this invention on an enlarged scale and partially in section.

The intermediate plate 8 may be snap fitted in the housing by having peripheral portions thereof snapped into interference fit ledge sections adjacent to the end walls of the housing as illustrated in FIG. 2.

Portions of the individual switches 5 project below the plate-shaped centerpiece into the area between the divider walls and terminate in a bottom face substantially parallel to the housing bottom 3. The bottom face is formed with a V-shaped recess 9 which runs crosswise to the movement direction of the switch interior of the housing. Contact springs 10 are positioned between the switch body bottom face and the housing floor 3. The contact springs 10 consist of sheet metal bands which are shaped in such a way that they contact both the housing floor and the switch body. The individual bands have, at their bottom-most extreme, two projections 30 which are positioned adjacent either end of a central contact bridge section 11 and which form contact points with the contact surfaces 37. From adjacent one of the projections 30, the contact spring 10 extends upwardly through a reverse bend and back towards the center of the contact bridge section through a central cross-section portion 12. From the end of the central contact section 12 at the center of the contact bridge section, the individual springs 10 are bent verticaly upwardly in a contact spring stem 13 running approximately vertically to the housing walls and reaching into the individual recess 9 of a spring body. The free dimensions of the individual springs 10 are greater than the installed vertical dimensions, whereby the spring is in pressed contact both with the base of the V-shaped recess 9 and the contact surfaces 37.

Thus each contact spring 10 urges the switch body with which it is associated in the direction of the open end of the housing such that the plate-shaped centerpiece 6 of the associated switch body is pressed against intermediate plate 8. This assures, that on the one hand, the contact pressure required for sufficient contact between the contact spring and the contact surfaces 37 will be created and maintained, and on the other hand, that undesired movement of the switches will be prevented by the friction between the plate-shaped centerpiece 6 and the intermediate plate 8.

Each of the switches is formed with a raised actuator 14 which projects above the plate-shaped centerpiece through elongated parallel openings 15 in the intermediate plate 8.

The tub-shaped housing 1 is closed at its open end or top by a lid 16. As illustrated, the lid 16 can be pivotably hinged between the longitudinal sidewalls of the housing and can be fixed in a closed position by means of a nose 17 over-lapping and projections 18 on the housing which provides for a snap lock by partial elastic deformation of the projections 18 at the ends of the longitudinal sidewalls. The lid 16 has a bottom surface forming the inner side of the lid when in the closed position. A rib or ridge 17 is formed on the inner surface which projects from the surface downwardly into the housing when the lid 16 is closed. The rib 17 is positioned intermediate the sidewalls of the lid and projects into the area internal of the housing through which the actuators 14 are moved. The rib 17 is formed as a wedge shaped member having sidewalls projecting at an angle to the vertical.

Each of the actuators 14 of the switches contained in the housing is formed with chamfered flanks or sidewalls 18 which have a curvature designed to cooperate with the wedge surface of the rib 17 to form a wedge-cam contact when the lid is being closed whereby if the actuators of any of the individual switches have not been fully thrown to the side, contact between the rib and the actuator will push the actuator to one side or the other of the rib. By dimensioning the rib and the actuators, it will be assured that the closure action of the lid will force the actuators fully to one side or the other of the housing whereby the individual switches will be in a fully thrown position. Thereafter, the actuators will be locked in position by the presence of the wedge shaped rib 17 which blocks movement of the actuators through the intermediate portion of the movement space of the individual switches.

Therefore, even in the case of negligent operation of one of the switches, the wedged profile of the rib 17 will push the affected switch into its respective switching position upon closure of the lid 16.

Figure 3:
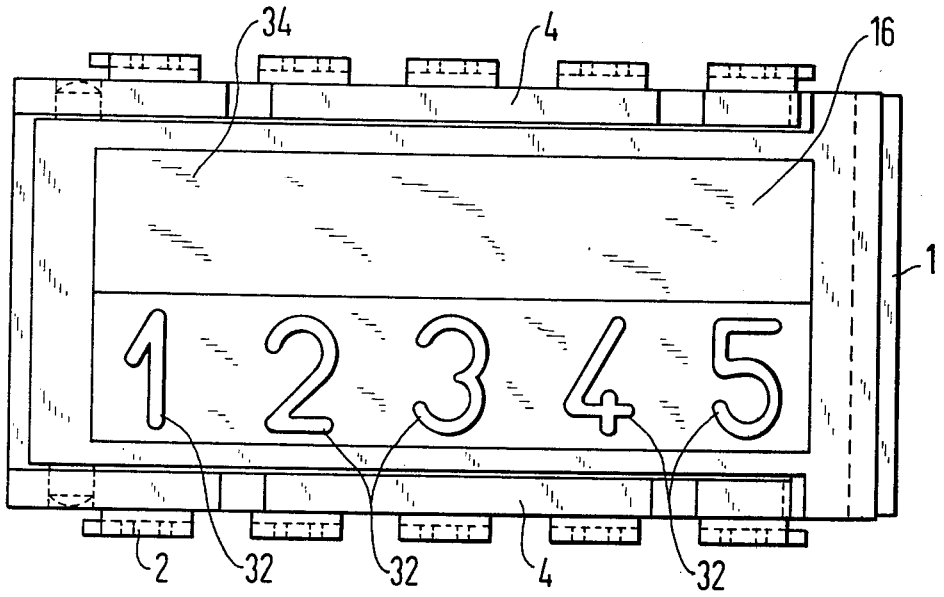
FIG. 3 is an enlarged top-plan view of the switches and housing of FIGS. 1 and 2.
Figure 4:
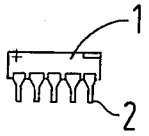
FIG. 4 is a side-plan view of the switches and housing of FIGS. 1–3 shown in a size more closely corresponding to the actual size.

In order to be able to readily recognize the switching condition of each of the individual switches when the lid is closed, the lid may be formed of a transparent plastic either in whole or in part. It is only necessary that half the lid, corresponding to that portion of the lid on one side or the other of the rib be formed transparent. The other portion of the lid may be formed with indicating numerals 32 which are aligned with the individual switch actuators. In this manner, the un-numeraled portion 34 of the switch housing lid shown in FIG. 3 will be formed transparently.

It can therefore be seen from the above that my invention provides a switch assembly which encompasses a plurality of individually actuatable slide switches received between the longitudinal sidewalls of a common housing, with the switches having a slide movement towards and away from the longitudinal sidewalls. The switches have actuators projecting into the upper reaches of a tub shaped housing, which is equipped with a closure lid at the top thereof, the closure lid having a locking rib projecting from its inner surface into the upper reaches of the tub shaped housing when the lid is closed. The presence of the rib effectively prevents further movement of the actuators from their activated or deactivated portion and provides a lock mechanism for the switches when the lid is closed. In addition the rib sides form cam surfaces which will contact the actuators during closure of the lid if the actuators are not in a fully thrown position. This contact will force the actuators of the various switches to move the switches into a fully thrown position upon closure of the lid.

Although the teachings of my invention have herein been discussed with reference to specific theories and embodiments, it is to be understood that these are by way of illustration only and that others may wish to utilize my invention in different designs or applications.

I claim:

1. A switching device comprising: a plurality of independently operable switches arranged for parallel movement between activated and deactivated positions, said switches received in a common housing, a single locking member associated with said housing selectively actuatable to simultaneously lock all of said switches each in one of said positions, the housing being substantially tub shaped having longitudinal walls and end walls, the plurality of switches being locted interior of said housing having portions thereof projecting towards an open end of said housing, said portions being movable back and forth in the housing in a direction of movement parallel to one another between said longitudinal sidewalls, said locking member being attached to said housing member adjacent an end wall thereof and pivotable with respect to said housing, said locking member being pivotable to a point where a portion thereof projects into the interior of said housing and into a space occupiable therein by said portions of said switches during movement of said portions, the locking member has a wedge shaped profile in cross section between the longitudinal walls and the portions of the switches projecting up towards the open end being provided with chamfered sidewalls dimensioned with respect to the wedge shaped profile to provide a camming contact between the locking member and the portions upon movement of the locking member to its locking position, the switches have a portion thereof intermediate top and bottom ends thereof extending outwardly therefrom and entrapped between top sides of divider walls positioned within said housing projecting from a bottom thereof towards the open end thereof and an intermediate plate positioned in said housing with a bottom surface spaced from the top surface of the divider walls.

2. A switching device according to claim 1 wherein the switches have a bottom face opposed to a bottom of said housing member, the bottom face having a recess therein, a contact spring entrapped between the switch bottom face and the bottom of the housing having a portion thereof extending into said recess.

3. A switching device according to claim 2 wherein the contact springs consist of bands of spring metal which are bent to provide a bottom surface adjacent the floor of the housing, said bottom surface including two projections extending towards the floor of the housing, the projections connected together by a contact bridge section, a reverse bend of said band adjacent one of said projections, a central section substantially parallel to said contact bridge section overlying said contact bridge section extending from the said reverse bend to approximately the center of said contact bridge section, a stem section projecting away from said contact bridge section from said central section, the said stem section terminating in the said recess.

4. A switching device according to claim 2 wherein a plurality of sheet metal strips are positioned in said housing aligned with the floor of said housing extending crosswise to the longitudinal extension of the housing, the said sheet metal strips projecting from the longitudinal walls of the housing to the exterior thereof, said sheet metal strips bent exterior of the housing and extending therefrom substantially parallel to the longitudinal sidewalls of said housing, the projections of said contact springs contacting surface portions of said sheet metal strips interior of said housing.

5. A switching device comprising a tub shaped housing having an open top and a substantially closed bottom with longitudinal sidewalls and end walls, a plurality of pairs of metal contacts carried by said housing, each pair including one contact projecting through a longitudinal sidewall of the housing and a second contact projecting through the opposite longitudinal sidewall in aligned relationship with the one contact, each of said pairs of contacts longitudinally spaced of other of said pairs of contacts, a plurality of switches positioned in said housing, each of said switches including a switch body having an intermediate flange extending substantially parallel to the bottom of said housing, said intermediate flange entrapped between a divider wall of said housing extending between said longitudinal walls projecting above said bottom of said housing and an intermediate plate carried by said housing in spaced relation to the top of said divider wall, said intermediate plate having a plurality of slots therethrough, each of said switches having an actuator projecting above said flange through one of said slots, each of said switch bodies having a bottom surface opposed to the bottom of said housing, said bottom surface having a surface interruption therein, a contact spring entrapped between said switch body and the said bottom of said housing in a tensioned condition whereby said contact spring urges said switch body against the said intermediate plate, said switch body movable between said longitudinal sidewalls to move said contact spring into contact with only one or both of the members of one pair of contacts, said contact spring having a bottom surface with spaced apart projections interconnected by a contact bridge section, the projections extending from the contact bridge section towards the bottom of said housing, a closure lid pivotably attached to said housing adjacent one of said end walls, the closure lid effective to close the open end of the housing, the closure lid having a raised surface interruption running longitudinally thereof on an underside thereof, the surface interruption projecting into said housing below the remainder of said lid when the said lid is in a closed position, the surface interruption projecting into an area in said housing through which said actuators are movable, said surface interruption providing a locking member preventing movement of said actuators when said lid is closed, the surface interruption and the actuators having mated surfaces forming a cam surface contact during closure of said lid effective to force said actuators fully to one side or the other of said surface interruption.

* * * * *